US011100872B2

(12) United States Patent
Li et al.

(10) Patent No.: US 11,100,872 B2
(45) Date of Patent: Aug. 24, 2021

(54) METHOD AND APPARATUS FOR DISPLAY MODE SWITCHING BASED ON AMBIENT LIGHT

(71) Applicant: Xiaomi Inc., Beijing (CN)

(72) Inventors: Guosheng Li, Beijing (CN); Anyu Liu, Beijing (CN); Laijun Yan, Beijing (CN)

(73) Assignee: Xiaomi Inc., Beijing (CN)

( * ) Notice: Subject to any disclaimer, the term of this patent is extended or adjusted under 35 U.S.C. 154(b) by 135 days.

(21) Appl. No.: 15/150,696

(22) Filed: May 10, 2016

(65) Prior Publication Data

US 2017/0047019 A1 Feb. 16, 2017

(30) Foreign Application Priority Data

Aug. 13, 2015 (CN) ..... 201510497885.5

(51) Int. Cl.
*G09G 3/36* (2006.01)
*G09G 3/34* (2006.01)
*G09G 3/20* (2006.01)

(52) U.S. Cl.
CPC ..... *G09G 3/3406* (2013.01); *G09G 3/2092* (2013.01); *G09G 3/36* (2013.01);
(Continued)

(58) Field of Classification Search
None
See application file for complete search history.

(56) References Cited

U.S. PATENT DOCUMENTS 7,081,902 B1 * 7/2006 Crow ..... G09G 5/363 345/428
2003/0067435 A1 * 4/2003 Liu ..... G09G 3/3406 345/101
(Continued)

FOREIGN PATENT DOCUMENTS

CN 101751870 A 6/2010
CN 102404440 A 4/2012
(Continued)

OTHER PUBLICATIONS

Dictionary.com definition of mode, http://www.dictionary.com/browse/mode?s=t, p. 1.*
(Continued)

*Primary Examiner* — Kirk W Hermann
(74) *Attorney, Agent, or Firm* — Oblon, McClelland, Maier & Neustadt, L.L.P.

(57) ABSTRACT

Method and apparatus for mode switching are provided in the disclosure. Aspects of the disclosure provide a method for switching a display mode of a device. The method includes receiving an intensity value of ambient light when the device is in a first control mode in which backlights of a liquid crystal display screen are controlled in order to control a display brightness of the liquid crystal display screen, determining whether the intensity value is less than a predetermined threshold, and when the intensity value is less than the predetermined threshold, controlling the device to enter a second control mode in which voltages provided to data lines of the liquid crystal display screen are scaled according to a ratio in order to control the display brightness of the liquid crystal display screen.

12 Claims, 7 Drawing Sheets

(52) U.S. Cl.
CPC ... *G09G 2320/06* (2013.01); *G09G 2320/062* (2013.01); *G09G 2320/0626* (2013.01); *G09G 2360/144* (2013.01)

(56) References Cited

U.S. PATENT DOCUMENTS

| | | | | |
|---|---|---|---|---|
| 2006/0187233 | A1* | 8/2006 | Diefenbaugh | G09G 3/3413 345/591 |
| 2007/0153098 | A1* | 7/2007 | Kao | G09G 3/3611 348/234 |
| 2007/0229435 | A1* | 10/2007 | Lee | G09G 3/2011 345/98 |
| 2007/0282522 | A1* | 12/2007 | Geelen | G06Q 20/102 701/532 |
| 2008/0049005 | A1* | 2/2008 | Okita | G09G 3/3648 345/207 |
| 2008/0150883 | A1* | 6/2008 | Tokuyasu | G09G 3/3406 345/102 |
| 2008/0238860 | A1* | 10/2008 | Onodera | G09G 3/3413 345/102 |
| 2011/0018856 | A1* | 1/2011 | Den Boer | G09G 3/3413 345/211 |
| 2011/0102451 | A1* | 5/2011 | Broga | G09G 3/3406 345/589 |
| 2011/0141002 | A1* | 6/2011 | Kim | G09G 3/342 345/102 |
| 2011/0187687 | A1* | 8/2011 | Saitou | G02F 1/13318 345/207 |
| 2012/0194493 | A1* | 8/2012 | Soto | G09G 3/3406 345/207 |
| 2015/0070337 | A1* | 3/2015 | Bell | G09G 3/2003 345/207 |

FOREIGN PATENT DOCUMENTS

| | | | |
|---|---|---|---|
| CN | 103200313 | A | 7/2013 |
| CN | 104168371 | A | 11/2014 |
| CN | 104252327 | A | 12/2014 |
| CN | 104378688 | A | 2/2015 |
| CN | 104735247 | A | 6/2015 |
| CN | 104994241 | A | 10/2015 |
| EP | 1 780 991 | A1 | 5/2007 |
| EP | 2 492 905 | A1 | 8/2012 |
| JP | 2008-040488 | A | 2/2008 |
| JP | 2009-58342 | A | 3/2009 |
| JP | 2009-229520 | A | 10/2009 |
| JP | 2010-044384 | A | 2/2010 |
| JP | 2010-145488 | A | 7/2010 |
| JP | 2013-134292 | A | 7/2013 |
| JP | 2015-25834 | A | 2/2015 |
| KR | 10-0844775 | B1 | 7/2008 |
| RU | 2 158 059 | C1 | 10/2000 |

OTHER PUBLICATIONS

Combined Office Action and Search Report dated Dec. 25, 2017 in Chinese Patent Application No. 201510497885.5 (with English translation of categories of cited documents), 11 pages.

Extended European Search Report dated Nov. 2. 2016 in Application No. 16159518.6.

International Search Report and Written Opinion dated Apr. 28. 2016 in PCT/CN2015/098958 (will, English Translation; of Categories of Cited Documents).

Office Action dated Apr. 20, 2017 in Korean Patent Application No. 10-2016-7004807 (with English translation).

Combined Office Action and Search Report dated Jun. 13, 2917 in Russian Patent Application No. 201610800.

Japanese Office Action issued in Japanese Patent Application No. 2017-533682 dated May 8, 2018.

Japanese Office Action dated Sep. 28, 2017 in Patent Application No. 2017-533682.

Korean Office Action dated Oct. 31, 2017 in Patent Application No. 10-2016-7004807.

* cited by examiner

METHOD AND APPARATUS FOR DISPLAY MODE SWITCHING BASED ON AMBIENT LIGHT

CROSS-REFERENCE TO RELATED APPLICATIONS

This application is based upon and claims priority to Chinese Patent Application No. 201510497885.5, filed Aug. 13, 2015, which is incorporated herein by reference in its entirety.

FIELD

The present disclosure generally relates to display technology, and more particularly, to a method and apparatus for mode switching.

BACKGROUND

Mobile terminals such as smart phone, tablet and computer are most commonly used electronic devices for users.

When mobile terminals are used at night, contents displayed thereon will be very dazzling due to low brightness of the ambient light. A night mode which will be manually enabled under low ambient light conditions is provided in related art. In the night mode, backlight brightness may be adjusted to a lowest level and the background of the UI may be altered to black or other dark tones. However, contents displayed on mobile terminals may still be too dazzling when the brightness of the ambient light is extremely low.

SUMMARY

In view of the fact in related arts that contents displayed on a mobile terminal may not adapt to an ambient light condition by adjusting brightness of backlights or a background color of a UI when brightness of ambient light is extremely low, a method and apparatus for mode switching are provided in the disclosure. Technical solutions are listed below.

Aspects of the disclosure provide a method for switching a display mode of a device. The method includes receiving an intensity value of ambient light when the device is in a first control mode in which backlights of a liquid crystal display screen are controlled in order to control a display brightness of the liquid crystal display screen, determining whether the intensity value is less than a predetermined threshold, and when the intensity value is less than the predetermined threshold, controlling the device to enter a second control mode in which voltages provided to data lines of the liquid crystal display screen are scaled according to a ratio in order to control the display brightness of the liquid crystal display screen.

To control the device to enter the second control mode in which the voltages provided to the data lines of the liquid crystal display screen are scaled according to the ratio in order to control the display brightness of the liquid crystal display screen, in an example, the method includes determining a night mode level corresponding to the intensity value according to a first correspondence relationship between intensity values and night mode levels, determining the ratio corresponding to the night mode level, and scaling the voltages provided to the data lines of the liquid crystal display screen according to the determined ratio.

According to an aspect of the disclosure, the method further includes determining whether the intensity value is less than a previously received intensity value when the device is in the first control mode, and when the intensity value is less than the previously received intensity value, controlling the backlights to reduce backlight brightness of the liquid crystal display screen.

In an example, to control the backlights to reduce the backlight brightness of the liquid crystal display screen, the method includes determining the backlight brightness corresponding to the intensity value according to a second correspondence relationship between intensity values and backlight brightness, and controlling the backlights of the liquid crystal display screen to achieve the determined backlight brightness.

Aspects of the disclosure provide a method for switching a display mode of a device. The method includes receiving an intensity value of ambient light when the device is in a first control mode in which voltages provided to data lines of a liquid crystal display screen are scaled according to a ratio in order to control a display brightness of the liquid crystal display screen, determining whether the intensity value is greater than a predetermined threshold, and when the intensity value is greater than the predetermined threshold, exiting from the first control mode and entering a second control mode in which backlights of the liquid crystal display screen are controlled in order to control the display brightness of the liquid crystal display screen.

In an example, to exit from the first control mode, the method includes providing the voltages without scaling to the data lines of the liquid crystal display screen.

According to an aspect of the disclosure, the method includes when the intensity value is not greater than the predetermined threshold, determining whether the intensity value is greater than a previously received intensity value, when the intensity value is greater than the previously received intensity value, determining a night mode level corresponding to the intensity value according to a first correspondence relationship between intensity values and night mode levels, determining a ratio corresponding to the determined night mode level, and scaling the voltages provided to the data lines of the liquid crystal display screen according to the determined ratio.

To enter the second control mode in which the backlights of the liquid crystal display screen are controlled in order to control the display brightness of the liquid crystal display screen, in an example, the method includes determining backlight brightness corresponding to the intensity value according to a second correspondence relationship between intensity values and backlight brightness, and controlling the backlights of the liquid crystal display screen to achieve the determined backlight brightness.

Aspects of the disclosure provide a device for switching a display mode. The method includes a processor, and a memory for storing instructions executable by the processor. The instructions, when executed by the processor, cause the processor to receive an intensity value of ambient light when the device is in a first control mode in which backlights of a liquid crystal display screen are controlled in order to control a display brightness of the liquid crystal display screen, determine whether the intensity value is less than a predetermined threshold, and when the intensity value is less than the predetermined threshold, control the device to enter a second control mode in which voltages provided to data lines of the liquid crystal display screen are scaled according to a ratio in order to control the display brightness of the liquid crystal display screen.

Aspects of the disclosure provide a device for switching a display mode. The device includes a processor and a memory for storing instructions executable by the processor. The instructions, when executed by the processor, cause the processor to receive an intensity value of ambient light when the device is in a first control mode in which voltages provided to data lines of a liquid crystal display screen are scaled according to a ratio in order to control a display brightness of the liquid crystal display screen, determine whether the intensity value is greater than a predetermined threshold and when the intensity value is greater than the predetermined threshold, exit from the first control mode and enter a second control mode in which backlights of the liquid crystal display screen are controlled in order to control the display brightness of the liquid crystal display screen.

It is to be understood that both the forgoing general description and the following detailed description are exemplary only, and are not restrictive of the present disclosure.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which same numbers in different drawings represent same or similar elements unless otherwise described. The implementations set forth in the following description of exemplary embodiments do not represent all implementations consistent with the invention. Instead, they are merely examples of apparatuses and methods consistent with aspects related to the invention as recited in the appended claims.

Embodiments provided in the present disclosure are illustrated with respect to a mobile terminal. The mobile terminal may include at least a light intensity sensor and liquid crystal display screen. The liquid crystal display screen may include backlights, TFT (Thin Film Transistor) switch elements, liquid crystal units and the like. The light intensity sensor is configured to acquire an intensity value of the current ambient light; the liquid crystal display screen is configured to display output contents of the mobile terminal; backlights are configured to control the brightness of the liquid crystal display screen; and TFT switch elements are configured to control grayscale voltages corresponding to crystal liquid units of the liquid crystal display screen.

When a mobile terminal is in the normal display mode, the display mode of the mobile terminal may change with the change of the intensity value if a user of the mobile terminal enters to an environment of a higher intensity value from an environment of a lower intensity value.

Figure 1:
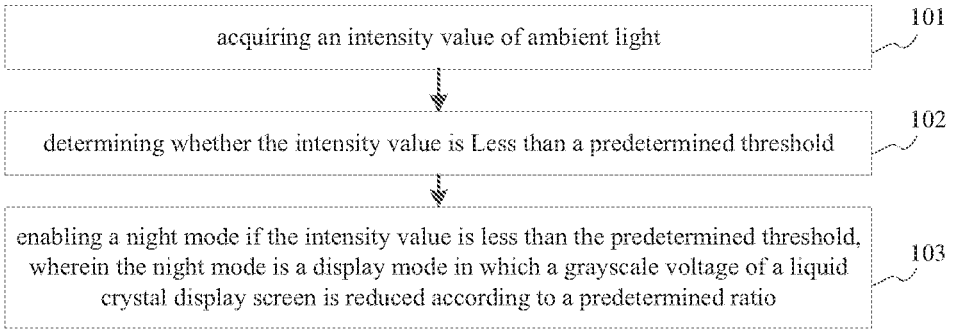
FIG. 1 is a flow chart illustrating a method for mode switching according to an exemplary embodiment.

FIG. 1 is a flow chart showing a method for mode switching according to an exemplary embodiment. The embodiment will be illustrated by applying the method to a mobile terminal including a light intensity sensor and a liquid crystal display screen. The method may include the following steps.

In step 101, an intensity value of ambient light is acquired.

In step 102, whether the intensity value is less than a predetermined threshold is determined.

In step 103, a night mode may be enabled if the intensity value is less than the predetermined threshold, wherein the night mode is a display mode in which a grayscale voltage of the liquid crystal display screen is reduced according to a predetermined ratio.

From the above, the mode switching method provided by the present embodiment is a method by which: an intensity value of ambient light is acquired to determine whether it is less than a predetermined threshold; if the intensity value is less than the predetermined threshold, a night mode may be enabled, wherein the night mode is a display mode in which a grayscale voltage of a liquid crystal display screen is reduced according to a predetermined ratio. The problem that contents displayed on a mobile terminal may not adapt to an ambient light condition by adjusting brightness of backlights or a background color of the UI when brightness of ambient light is extremely low may be solved, and the effect that the brightness of the screen is reduced by reducing a grayscale voltage of a liquid crystal display screen may be realized.

Figure 2A:
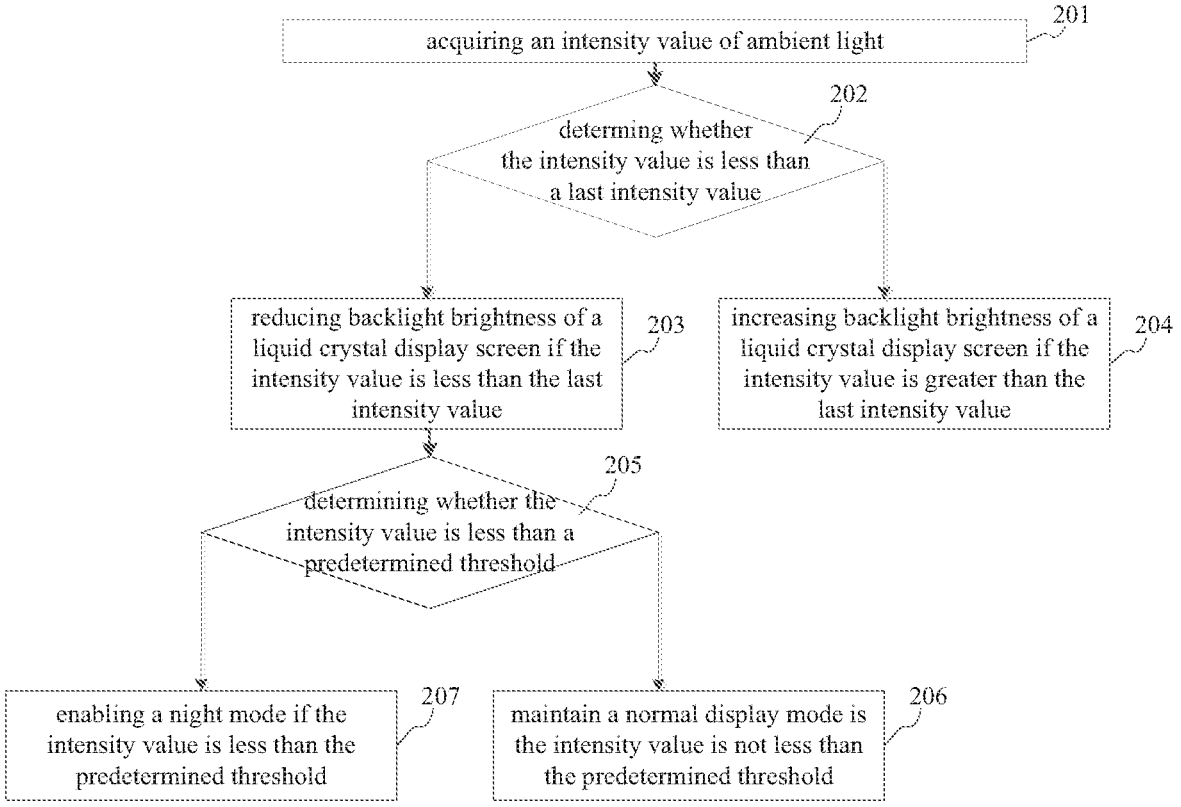
FIG. 2A is a flow chart illustrating another method for mode switching according to an exemplary embodiment.

FIG. 2A is a flow chart of another method for mode switching according to an exemplary embodiment. The embodiment will be illustrated by applying the method to a mobile terminal including a light intensity sensor and a liquid crystal display screen. The method may include the following steps.

In step 201, an intensity value of the ambient light is acquired.

The intensity value of the ambient light refers to the illumination intensity of the current environment.

The intensity value of the ambient light may be acquired by a mobile terminal at predetermined time intervals when the mobile terminal is in a normal display mode.

Optionally, the current illumination intensity of the ambient light may be acquired by the mobile terminal through a built-in light intensity sensor.

In the embodiment, the way to acquire the intensity value of the ambient light is not limited.

In step 202, whether an intensity value is less than a last intensity value that is acquired last time is determined.

It is provided that the mobile terminal acquires intensity values of the ambient light at predetermined time intervals. The intensity value is compared to the last intensity value by the mobile terminal to determine whether the intensity value is less than the last intensity value.

The method may proceed to step 203 if the intensity value is less than the last intensity value; otherwise the method may proceed to step 204.

In step 203, backlight brightness of the liquid crystal display screen may be reduced if the intensity value is less than the last intensity value.

Figure 2B:
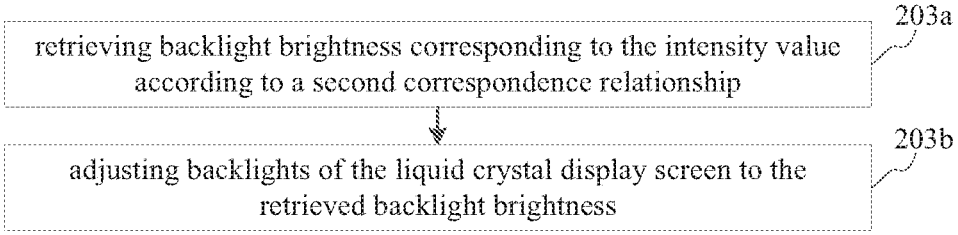
FIG. 2B is a flow chart for the sub-steps of step 203 in FIG. 2A.

This step may include the following steps, as illustrated in FIG. 2B:

In step 203*a*, the backlight brightness corresponding to the intensity value may be retrieved according to a second correspondence relationship.

The second correspondence relationship refers to a correspondence relationship between intensity values and the backlight brightness.

Optionally, a region of intensity values of the ambient light corresponds to a backlight brightness level. Different backlight brightness levels may be obtained if intensity values of the ambient light are divided into different regions. The backlight brightness may reduce accordingly if the intensity value of the ambient light reduces.

In an exemplary embodiment, it is assumed that the intensity value of the ambient light varies from 0 to 500 lx, wherein lx is a unit (lux) of illumination intensity. Intensity values of the ambient light are divided into regions each has a size of 50 lx. Regions of intensity values of the ambient light correspond to different backlight brightness levels. Assuming that the backlight brightness which has been adjusted to the lowest level could not adapt to the intensity value, the correspondence relationship is shown in the following table.

TABLE 1

| Regions of intensity values | Backlight brightness levels |
|---|---|
| (450-500) | Ninth backlight brightness level |
| (400-450) | Eighth backlight brightness level |
| (350-400) | Seventh backlight brightness level |
| (300-350) | Sixth backlight brightness level |
| (250-300) | Fifth backlight brightness level |
| (200-250) | Forth backlight brightness level |
| (150-200) | Third backlight brightness level |
| (100-150) | Second backlight brightness level |
| (50-100) | First backlight brightness level |

The correspondence relationship between regions of intensity values of the ambient light and backlight brightness levels is referred to as a second correspondence relationship. If the intensity value of the ambient light is 75, it can be seen from the correspondence relationship in Table 1 that the backlight brightness of the mobile terminal may be at the first level. The backlight brightness of a lower level may have lower brightness and the backlight brightness of a higher level may have higher brightness.

In step 203*b*, the backlight of the liquid crystal display screen may be adjusted to the retrieved backlight brightness.

The backlight of the liquid crystal display screen may be adjusted to the backlight brightness corresponding to the intensity value according to the second correspondence relationship and the intensity value.

In step 204, the backlight brightness may be increased if the intensity value is higher than the last intensity value.

The process to increase the backlight brightness may be performed by the method illustrated in FIG. 2B.

In step 205, whether the intensity value is less than a predetermined threshold is determined.

Whether the intensity value is less than a predetermined threshold is determined after the backlight brightness is reduced.

The predetermined threshold refers to an experience value obtained after multiple tests by developers. The experience value may be selected as a value at which the backlight brightness of the lowest level could not adapt to the intensity value of the ambient light.

The method may proceed to step 206 if the intensity value is not less than the predetermined threshold; otherwise the method may proceed to step 207.

In step 206, the normal display mode may be maintained if the intensity value is not less than the predetermined threshold.

The backlight brightness may be reduced to adapt to the brightness corresponding to the current intensity value if the intensity value of the ambient light is no less than the predetermined threshold.

In step 207, the night mode may be enabled if the intensity value is less than the predetermined threshold.

The intensity value of the ambient light is compared to the predetermined threshold;

The night mode may be enabled if the intensity value of the ambient light is less than the predetermined threshold;

Optionally, the backlight brightness may be reduced to adapt to the brightness corresponding to the current intensity value if the intensity value of the ambient light is no less than the predetermined threshold.

Figure 2C:
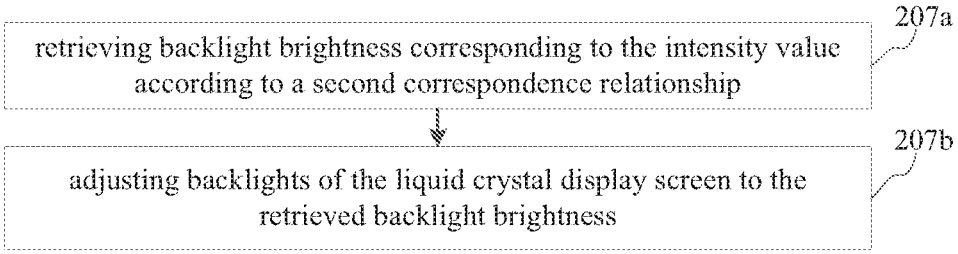
FIG. 2C is a flow chart for the sub-steps of step 207 in FIG. 2A.

This step may include the following steps, as illustrated in FIG. 2C:

In step 207*a*, a night mode level corresponding to the intensity value may be retrieved according to a first correspondence relationship.

The first correspondence relationship refers to a correspondence relationship between intensity values of the ambient light and night mode levels.

Optionally, a region of intensity values of the ambient light corresponds to a night mode level. Different night mode levels may be obtained if intensity values of the ambient light are divided into different regions. The night mode level may be increased if the intensity value of the ambient light reduces.

In an exemplary embodiment, it can be seen from the abovementioned Table 1 that the backlight brightness of the lowest level could not adapt to the intensity value when the intensity value is between 0-50 lx. Assuming that the predetermined threshold is 50 lx. Intensity values of the ambient light are divided into regions each has a size of 10 lx (that is to say, there may be 5 regions) and regions of intensity values of the ambient light are make correspondent to different night mode levels. The correspondence relationship between regions of intensity values of the ambient light and night mode levels is referred to as a first correspondence relationship. The correspondence relationship is shown in the following table:

TABLE 2

| Regions of intensity values | Night mode levels |
|---|---|
| (40-50) | First level |
| (30-40) | Second level |
| (20-30) | Third level |
| (10-20) | Forth level |
| (0-10) | Fifth level |

If the intensity value of the current ambient light is 25, it can be seen from the correspondence relationship in Table 2 that a mobile terminal may be in a night mode which is at the third level.

In the embodiment, intensity values and corresponding backlight brightness levels in Table 1 and intensity values and corresponding night mode levels in Table 2 are for illustrative purposes only, the correspondence relationship between Table 1 and Table 2 is not limited by the embodiment.

In step 207*b*, the grayscale voltage of the liquid crystal display screen is reduced according to a ratio corresponding to the night mode level.

The grayscale voltage of the liquid crystal display screen refers to a drain voltage of a liquid crystal display unit connected with a data line of the data driver chip.

Figure 3:
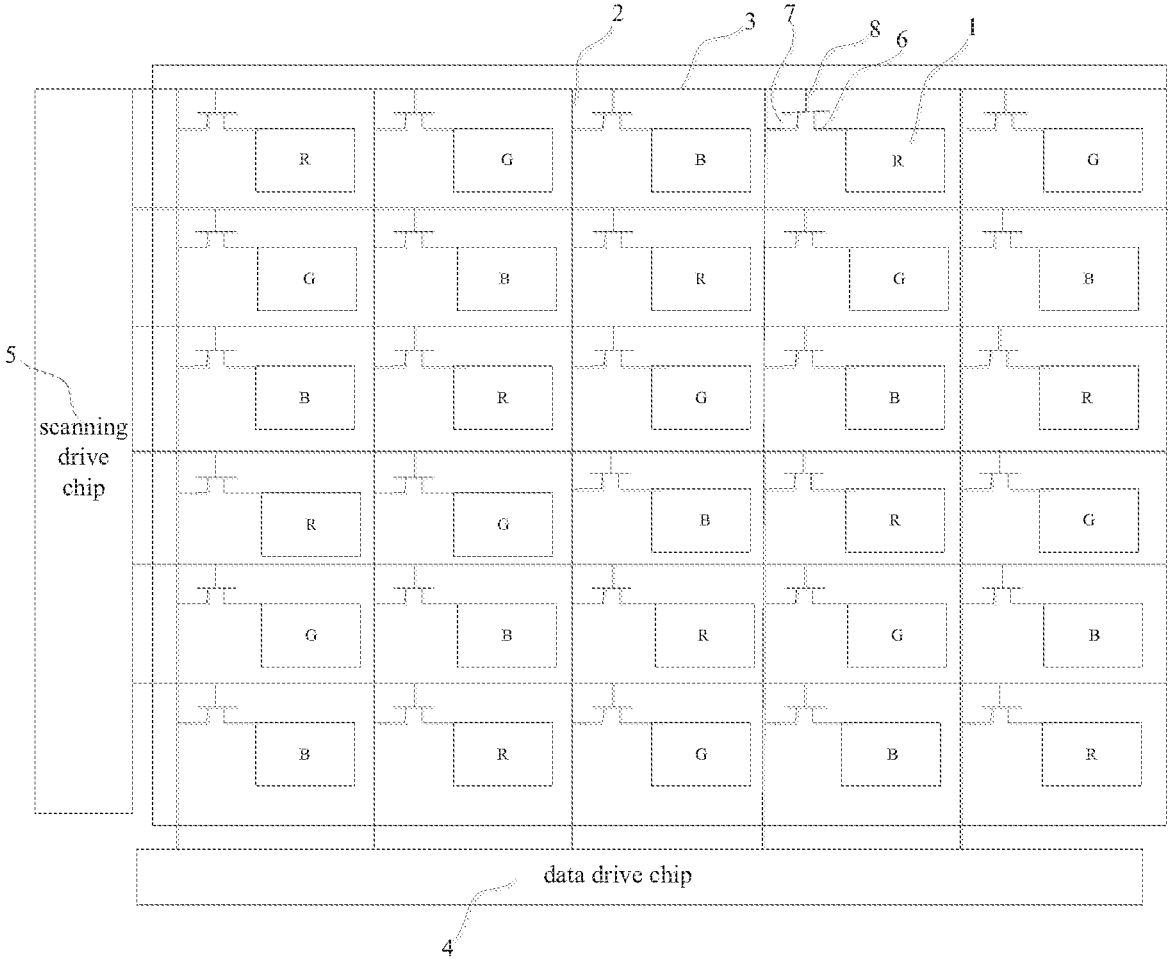
FIG. 3 is a schematic diagram illustrating the structure of an array substrate on TFT-LCD.

FIG. 3 is a schematic diagram of the structure of an array substrate on TFT-LCD, which includes liquid crystal pixel electrodes 1 arranged in a matrix form, data lines 2 and scanning lines 3 disposed between rows and columns of liquid crystal pixel electrodes 1, wherein data lines 2 are coupled to a data driver chip 4 and scanning lines 3 are coupled to a scanning driver chip 5. Generally speaking, one data line 2 is coupled to and controls one column of liquid crystal pixel electrodes 1 correspondingly, and one scanning line 3 is coupled to and controls one row of liquid crystal pixel electrodes 1 correspondingly. Each liquid crystal pixel electrode 1 is coupled to a source electrode 6, a drain electrode 7 corresponding to the source electrode 6 is coupled to a corresponding data line 2. A gate electrode 8 corresponding to the source electrode 6 and the drain electrode 7 is coupled to a corresponding scanning line 3. A TFT switching element is composed of the source electrode 6, the drain electrode 7 and the gate electrode 8.

During operation of the array substrate, data lines 2 are configured to transmit video signals in the data driver chip 4 to drain electrodes 7 of TFT switching elements to control voltages of liquid crystal pixel electrodes.

During operation of a liquid crystal display device, the following actions may be performed for one frame: a video signal may be transmitted by the data driver chip 4 to drain electrodes 7 over data lines 2, scanning lines 3 are then turned on row by row under the control of the scanning driver chip 5, such that a corresponding voltage for the data is stored on pixel electrodes 1 by the data driver chip 4, producing grayscale voltages of different levels and realizing the display of each frame.

The grayscale voltage of the liquid crystal display screen corresponds to the drain voltage in the TFT-LCD array substrate, that is to say, the drain voltage of TFT-LCD array substrate being changed by a mobile terminal may result in the grayscale voltage of the liquid crystal display screen being changed. There is a predetermined correspondence relationship between grayscales and grayscale voltages, for example, grayscale 255 corresponds to grayscale voltage A while grayscale 215 corresponds to grayscale voltage B. The correspondence relationship may be in the form of a curve.

The night mode in the embodiment is realized by reducing the grayscale voltage corresponding to each grayscale according to a predetermined ratio based on an initially predetermined correspondence relationship. For example, if the predetermined ratio is 85%, then the grayscale voltage corresponding to grayscale 255 will be A*85% and the grayscale voltage corresponding to grayscale 215 will be B*85%.

A night mode level may be realized through reducing a grayscale voltage of a liquid crystal display screen according to a predetermined ratio, that is to say, there is a correspondence relationship between the night mode level and the predetermined ratio according to which the grayscale voltage of the liquid crystal display screen may be reduced. A mobile terminal may change the grayscale voltage of the liquid crystal display screen by the predetermined ratio according to the night mode level, thus realizing the night mode level that corresponds to the intensity value of the current ambient light.

In an exemplary embodiment, the correspondence relationship between the night node level and the predetermined ratio is shown in the following table:

TABLE 3

| Night mode levels | Predetermined ratios |
|---|---|
| First level | 85% |
| Second level | 75% |
| Third level | 65% |
| Forth level | 55% |
| Fifth level | 45% |

It can be seen from the correspondence relationship in Table 2 that the intensity value of the current ambient light corresponds to the third night mode level, and the third night mode level may be realized by changing the grayscale voltage of the liquid crystal display screen. That is to say, the grayscale voltage of the liquid crystal display screen may be changed to 65% of the normal grayscale voltage to realize the third night mode level.

In the embodiment, the correspondence relationship in Table 3 between night mode levels and predetermined ratios is for illustrative purposes only and is not limited by the embodiment.

It should be noted that the night mode provided in the embodiment may also include adjusting the backlight brightness to the lowest level or turn the background color of the UI to black or other dark tones in addition to reducing the grayscale voltage of the liquid crystal display screen. In the present embodiment, the brightness of the display may further be reduced even if the backlight brightness which has been adjusted to the lowest level could not adapt to the intensity value.

From the above, the mode switching method provided by the present embodiment is a method by which: an intensity value of the ambient light is acquired to determine whether it is greater than a last intensity value that is acquired last time; if the intensity value is less than the last intensity value the backlight brightness of the liquid crystal display screen may be reduced; whether the intensity value is less than a predetermined threshold is determined; if the intensity value is less than the predetermined threshold, the night mode may be enabled, wherein the night mode is a display mode in which a grayscale voltage of the liquid crystal display screen is reduced according to a predetermined ratio. The problem that contents displayed on a mobile terminal may not adapt to an ambient light condition by adjusting brightness of backlights or a background color of the UI when brightness of ambient light is extremely low may be solved, and an effect that the brightness of the screen is reduced by reducing the grayscale voltage of the display may be realized.

When a mobile terminal is in night mode state, contents on the mobile terminal in night mode will not display clearly if a user enters an environment of a higher intensity value from an environment of a lower intensity value, resulting in unable to operate. Reference may be made to the following embodiment.

Figure 4:
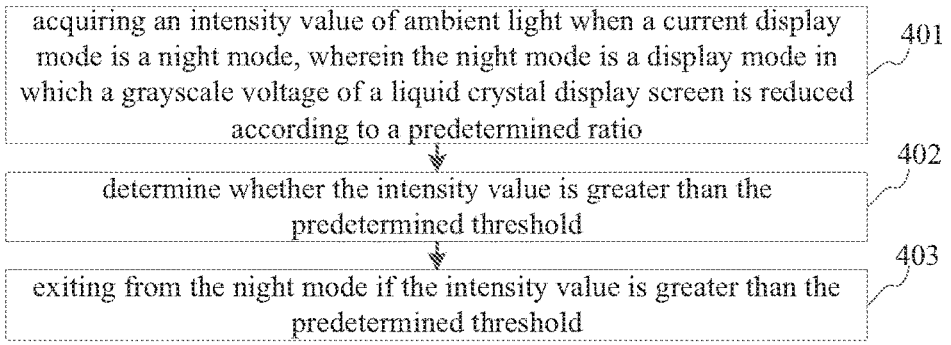
FIG. 4 is a flow chart illustrating a method for mode switching according to an exemplary embodiment.

FIG. 4 is a flow chart showing a method for mode switching according to an exemplary embodiment. The method may include the following steps.

In step 401, an intensity value of the ambient light is acquired when a current display mode is a night mode. The night mode is a display mode in which a grayscale voltage of a liquid crystal display screen is reduced according to a predetermined ratio.

In step 402, whether the intensity value is greater than a predetermined threshold is determined.

In step 403, the night mode is exited from if the intensity value is greater than a predetermined threshold.

From the above, the mode switching method provided by the present embodiment is a method by which: an intensity value of the ambient light is acquired to determine whether it is greater than a predetermined threshold when a current display mode a night mode; if the intensity value is greater than the predetermined threshold, exit from the night mode. The problem that a mobile terminal may be unable to operate due to the increase of the intensity value of the ambient light when the current display mode is night mode may be solved, and an effect that the brightness of the screen is improved by raising the grayscale voltage of the display and the brightness of the backlight may be realized.

Figure 5:
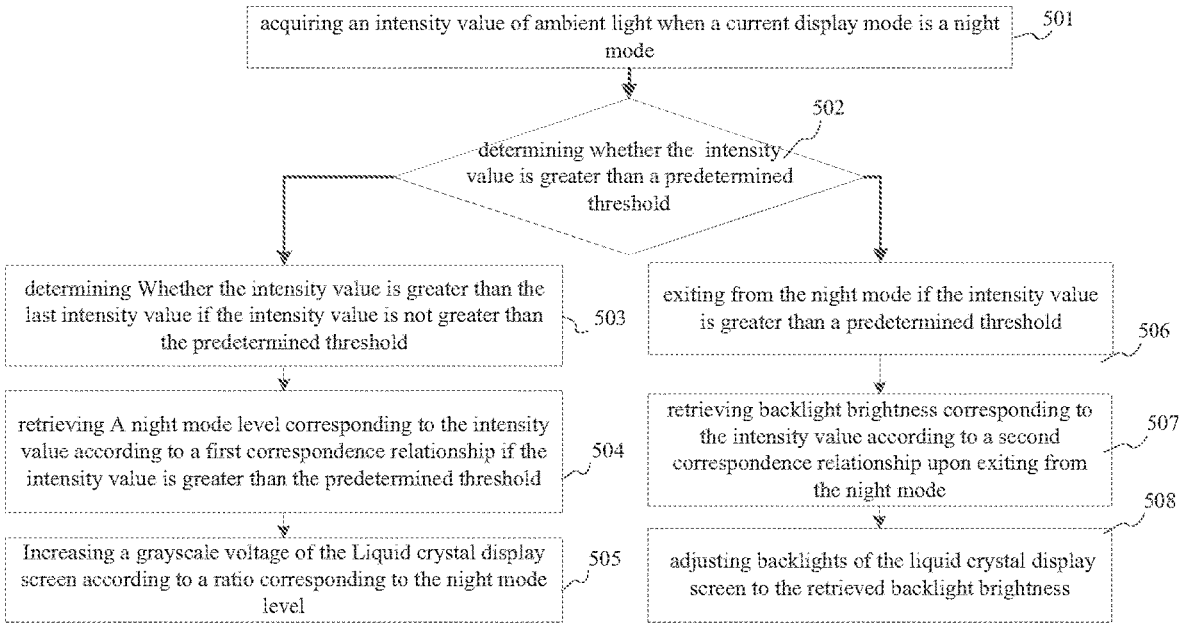
FIG. 5 is a flow chart illustrating another method for mode switching according to an exemplary embodiment.

FIG. 5 is a flow chart showing another method for mode switching according to an exemplary embodiment. The method may include the following steps.

In step 501, an intensity value of the ambient light is acquired when the current display mode is night mode.

A night mode is a display mode in which a grayscale voltage of the liquid crystal display screen is reduced according to a predetermined ratio.

The intensity value of the ambient light refers to the illumination intensity of the current environment. The intensity value of the ambient light may be acquired by a mobile terminal at predetermined time intervals to help detect variations of the ambient light.

In step 502, whether the acquired intensity value is greater than a predetermined threshold is determined.

The predetermined threshold refers to an experience value obtained after multiple tests by developers. The experience value may be selected as a value at which the backlight brightness of the lowest level could not adapt to the intensity value of the ambient light.

In step 503, if the intensity value is not greater than the predetermined threshold, whether the intensity value is greater than the last intensity value is determined.

If the intensity value is not greater than the predetermined threshold, the intensity value is compared to the last intensity value to determine whether the intensity value is greater than the last intensity value.

In step 504, if the intensity value is greater than the predetermined threshold, a night mode level corresponding to the intensity value may be retrieved according to a first correspondence relationship.

The first correspondence relationship refers to the correspondence relationship between the intensity value of the ambient light and the night mode level.

Optionally, a region of intensity values of the ambient light corresponds to a night mode level. Different night mode levels may be obtained if intensity values of the ambient light are divided into different regions. The night mode level may be increased if the intensity value of the ambient light reduces.

For example, according to the correspondence relationship in Table 2, assuming that the current night mode is at the third level, the current night mode may be elevated to the second level if the intensity value falls within the second region.

In step 505, the grayscale voltage of the liquid crystal display screen is raised according to a ratio corresponding to the night mode level.

The grayscale voltage of the liquid crystal display screen refers to a drain voltage of a liquid crystal display unit connected with a data line of the data driver chip.

The correspondence relationship between night mode levels and predetermined ratios is shown in Table 3.

For example, assuming that the current night mode is at the third level, the grayscale voltage of the liquid crystal display screen may be elevated from 65% of the normal grayscale voltage that the night mode of the third level corresponds to 75% of the normal grayscale voltage if the intensity value falls within the second region (i.e. corresponds to the second level of the nigh mode).

In step 506, exit from the night mode if the intensity value is greater than a predetermined threshold.

The mobile terminal exiting from the night mode may include the grayscale voltage of the liquid crystal display screen being restored to a normal grayscale voltage.

The drain voltage of the liquid crystal display unit connected with a data line of the data driver chip may be restored to the normal grayscale voltage if the intensity value is greater than the predetermined threshold.

In step 507, upon exiting from the night mode, the backlight brightness corresponding to the intensity value may be retrieved according to a second correspondence relationship.

The second correspondence relationship refers to a correspondence relationship between intensity values and backlight brightness.

Optionally, a region of intensity values of the ambient light corresponds to a backlight brightness level. Different backlight brightness levels may be obtained if intensity values of the ambient light are divided into different regions, that is to say, the backlight brightness may be increased accordingly if the intensity value of the ambient light increases.

The correspondence relationship between intensity values and the backlight brightness is shown in Table 1, and step 203*a* may be referred to for relevant description.

In step 508, backlights of the liquid crystal display screen may be adjusted to the retrieved backlight brightness.

The backlight of the liquid crystal display screen may be adjusted to the backlight brightness corresponding to the intensity value according to the second correspondence relationship and the intensity value.

From the above, the mode switching method provided by the present embodiment is a method by which: an intensity value of the ambient light is acquired when the current display mode is night mode; whether an intensity value is greater than a predetermined threshold is determined; if the intensity value is not greater than the predetermined threshold, whether the intensity value is greater than the last intensity value is determined; if the intensity value is greater than the predetermined threshold, a night mode level corresponding to the intensity value may be retrieved; if the intensity value is greater than a predetermined threshold, the night mode may be exited from, the grayscale voltage of the liquid crystal display screen may be restored to a normal grayscale voltage and the backlight of the liquid crystal display screen may be adjusted to the retrieved backlight brightness. The problem that a mobile terminal may be unable to operate due to the increase of the intensity value of the ambient light when the current display mode is night mode may be solved, and an effect that the brightness of the screen is improved by raising the grayscale voltage of the display and the brightness of the backlight may be realized.

Embodiments of apparatus of the disclosure for implementing embodiments of methods of the disclosure are described in the following. Embodiments of methods of the disclosure may be referred to for details not disclosed in embodiments of apparatus of the disclosure.

Figure 6:
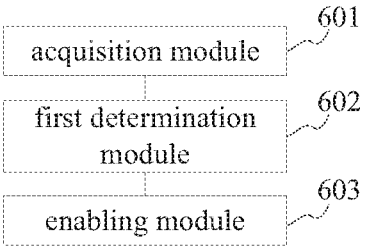
FIG. 6 is a block diagram illustrating a device for mode switching according to an exemplary embodiment.

FIG. 6 is a block diagram showing a device for mode switching according to an exemplary embodiment. The device for mode switching may be the whole or only part of a mobile device by implementation of software, hardware, or a combination of both. The device for mode switching may include:

an acquisition module 601 configured to acquire an intensity value of the ambient light;

a first determination module 602 configured to determine whether the intensity value to is less than a predetermined threshold;

an enabling module 603 configured to enable the night mode when an intensity value is less than a predetermined threshold, wherein night mode is a display mode in which a grayscale voltage of a display screen is reduced according to a predetermined ratio.

From the above, the mode switching apparatus provided by the present embodiment is an apparatus by which: an intensity value of the ambient light is acquired to determine whether it is greater than a predetermined threshold; if the intensity value is less than the predetermined threshold, the night mode may be enabled, wherein night mode is a display mode in which a grayscale voltage of a display screen is reduced according to a predetermined ratio. The problem that contents displayed on a mobile terminal may not adapt to an ambient light condition by adjusting brightness of backlights or a background color of the UI when brightness of ambient light is extremely low may be solved, and an effect that the brightness of the screen is reduced by reducing the grayscale voltage of the display may be realized.

Figure 7:
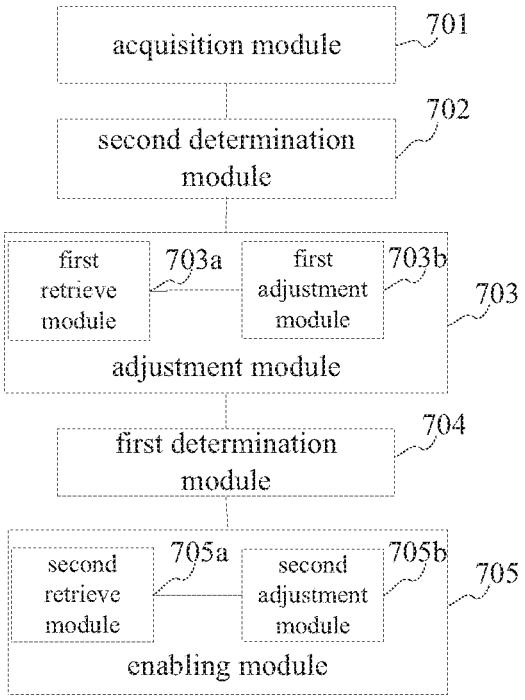
FIG. 7 is a block diagram illustrating another device for mode switching according to an exemplary embodiment.

FIG. 7 is a block diagram showing another device for mode switching according to an exemplary embodiment. The device for mode switching may be the whole or only part of a mobile device by implementation of software, hardware, or a combination of both. The device for mode switching may include:

an acquisition module 701 configured to acquire an intensity value of the ambient light;

a second determination module 702 configured to determine whether an intensity value is less than a last intensity value that is acquired last time;

a manipulation module 703 configured to reduce the backlight brightness of the liquid crystal display screen when the intensity value is less than the last intensity value;

a first retrieve module 703*a* configured to retrieve the backlight brightness corresponding to the intensity value according to a second correspondence relationship, wherein the second correspondence relationship refers to the correspondence relationship between intensity values and the backlight brightness;

a first adjustment module 703*b* configured to adjust the backlight of the liquid crystal display screen to the retrieved backlight brightness;

a first determine module 704 configured to determine whether the intensity value is less than the predetermined threshold;

an enabling module 705 configured to enable the night mode when the intensity value is less than the predetermined threshold, wherein night mode is a display mode in which a grayscale voltage of a liquid crystal display screen is reduced according to a predetermined ratio;

a second retrieve module 705*a* configured to retrieve a night mode level corresponding to the intensity value according to a first correspondence relationship, wherein the first correspondence relationship refers to the correspondence relationship between intensity values and night mode levels;

a second adjustment module 705*b* configured to reduce the grayscale voltage of the liquid crystal display screen according to a predetermined ratio corresponding to the night mode level.

From the above, the mode switching apparatus provided by the present embodiment is an apparatus by which: an intensity value of the ambient light is acquired to determine whether it is greater than a last intensity value that is acquired last time; if the intensity value is less than the last intensity value, the backlight brightness of the liquid crystal display screen may be reduced; whether the intensity value is less than a predetermined threshold is determined; if the intensity value is less than the predetermined threshold, the night mode may be enabled, wherein night mode is a display mode in which a grayscale voltage of the liquid crystal display screen is reduced according to a predetermined ratio. The problem that contents displayed on a mobile terminal may not adapt to an ambient light condition by adjusting brightness of backlights or a background color of the UI when brightness of ambient light is extremely low may be solved, and an effect that the brightness of the screen is reduced by reducing the grayscale voltage of the display may be realized.

The way in which each module operates has been described in detail in embodiments of the corresponding method with respect to the above mentioned embodiments of the apparatus and will not be described herein again.

Figure 8:
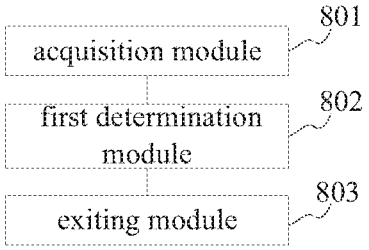
FIG. 8 is a block diagram illustrating a device for mode switching according to an exemplary embodiment.

FIG. 8 is a block diagram showing a device for mode switching according to an exemplary embodiment. The device for mode switching may be the whole or only part of a mobile device by implementation of software, hardware, or a combination of both. The device for mode switching may include:

an acquisition module 801 configured to acquire an intensity value of the ambient light when the current display mode is night mode, wherein night mode is a display mode in which a grayscale voltage of a display screen is reduced according to a predetermined ratio;

a first determination module 802 configured to determine whether an intensity value is greater than a predetermined threshold;

an exiting module 803 configured to exit from the night mode when the intensity value is greater than a predetermined threshold.

From the above, the mode switching apparatus provided by the present embodiment is an apparatus by which: an intensity value of the ambient light is acquired to determine whether it is greater than a predetermined threshold when the current display mode is night mode; if the intensity value is greater than the predetermined threshold, the night mode may be exited. The problem that a mobile terminal may be unable to operate due to the increase of the intensity value of the ambient light when the current display mode is night mode may be solved, and an effect that the brightness of the screen is improved by raising the grayscale voltage of the display and the brightness of the backlight may be realized.

Figure 9:
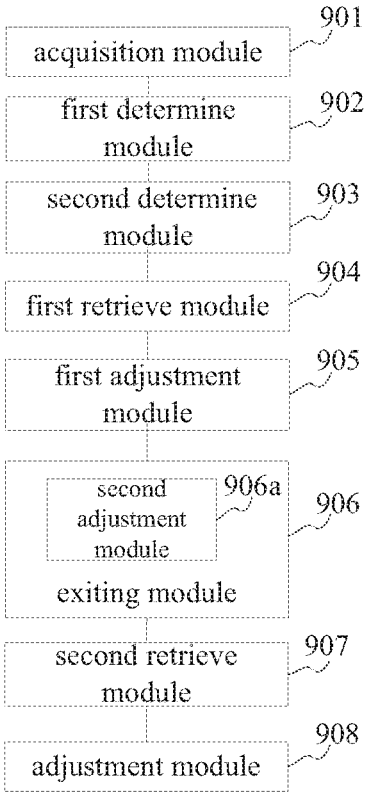
FIG. 9 is a block diagram illustrating another device for mode switching according to an exemplary embodiment.

FIG. 9 is a block diagram showing another device for mode switching according to an exemplary embodiment. The device for mode switching may be the whole or only part of a mobile device by implementation of software, hardware, or a combination of both. The device for mode switching may include:

an acquisition module 901 configured to acquire an intensity value of the ambient light, wherein night mode is a display mode in which a grayscale voltage of a display screen is reduced according to a predetermined ratio;

a first determine module 902 configured to determine whether an intensity value is greater than a predetermined threshold;

a second determine module 903 configured to determine whether an intensity value is greater than a last intensity value that is acquired last time when the intensity value is not greater than the predetermined threshold;

a first retrieve module 904 configured to retrieve a night mode level corresponding to the intensity value according to a first correspondence relationship when the intensity value is greater than the last intensity value, wherein the first correspondence relationship refers to the correspondence relationship between intensity values and night mode levels;

a first adjustment module 905 configured to raise the grayscale voltage of the liquid crystal display screen according to a ratio corresponding to the night mode level;

an exiting module 906 configured to exit from the night mode when the intensity value is greater than the predetermined threshold;

a second adjustment module 906*a* configured to restore the grayscale voltage of the liquid crystal display screen to a normal grayscale voltage;

a second retrieve module 907 configured to retrieve the backlight brightness corresponding to the intensity value according to a second correspondence relationship, wherein the second correspondence relationship refers to the correspondence relationship between intensity values and backlight brightness;

a manipulation module 908 configured to manipulate the backlight of the liquid crystal display screen to the retrieved backlight brightness.

The way in which each module operates has been described in detail in embodiments of the corresponding method with respect to the above mentioned embodiments of the apparatus and will not be described herein again.

From the above, the mode switching apparatus provided by the present embodiment is an apparatus by which: an intensity value of the ambient light is acquired to determine whether it is greater than a predetermined threshold when the current display mode is night mode; if the intensity value is not greater than the predetermined threshold, whether the intensity value acquired this time is greater than the last intensity value is determined; if the intensity value is greater than the last intensity value, a night mode level corresponding to the intensity value may be retrieved; if the intensity value is greater than a predetermined threshold, the night mode may be exited from, the grayscale voltage of the liquid crystal display screen may be restored to a normal grayscale voltage and the backlight of the liquid crystal display screen may be adjusted to the retrieved backlight brightness. The problem that a mobile terminal may be unable to operate due to the increase of the intensity value of the ambient light when the current display mode is night mode may be solved, and an effect that the brightness of the screen is improved by raising the grayscale voltage of the display and the brightness of the backlight may be realized.

It is noted that the various modules in the present disclosure can be implemented using any suitable technology. In an example, a module can be implemented using integrated circuit (IC). In another example, a module can be implemented as a processing circuit executing software instructions.

Figure 10:
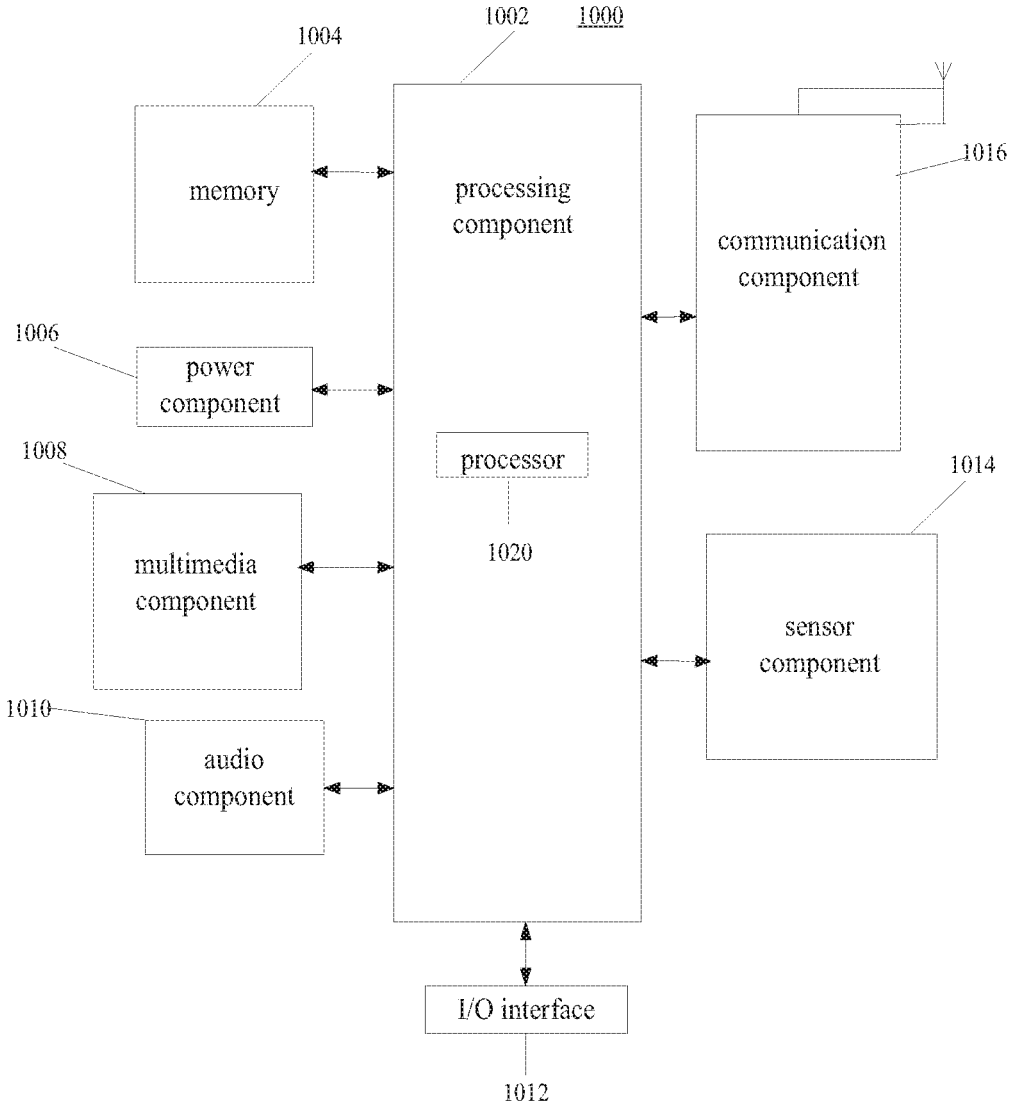
FIG. 10 is a block diagram illustrating a device for mode switching according to an exemplary embodiment.

FIG. 10 is a block diagram of a device for mode switching according to an exemplary embodiment. For example, the device 1000 may be a mobile phone, a computer, a digital broadcast terminal, a messaging device, a gaming console, a tablet, a medical device, exercise equipment, a personal digital assistant, and the like.

Referring to FIG. 10, the device 1000 may include one or more of the following components: a processing component 1002, a memory 1004, a power component 1006, a multimedia component 10010, an audio component 1010, an input/output (I/O) interface 1012, a sensor component 1014, and a communication component 1016.

The processing component 1002 typically controls overall operations of the device 1000, such as the operations associated with display, telephone calls, data communications, camera operations, and recording operations. The processing component 1002 may include one or more processors 1020 to execute instructions to perform all or part of the steps in the above described methods. Moreover, the processing component 1002 may include one or more modules which facilitate the interaction between the processing component 1002 and other components. For instance, the processing component 1002 may include a multimedia module to facilitate the interaction between the multimedia component 1008 and the processing component 1002.

The memory 1004 is configured to store various types of data to support the operation of the device 1000. Examples of such data include instructions for any applications or methods operated on the device 1000, contact data, phonebook data, messages, pictures, video, etc. The memory 1004 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 1006 provides power to various components of the device 1000. The power component 1006 may include a power management system, one or more power sources, and any other components associated with the generation, management, and distribution of power in the device 1000.

The multimedia component 1008 includes a screen providing an output interface between the device 1000 and the user. In some embodiments, the screen may include a liquid crystal display and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1008 includes a front camera and/or a rear camera. The front camera and the rear camera may receive an external multimedia datum while the device 1000 is in an operation mode, such as a photographing mode or a video mode. Each of the front camera and the rear camera may be a fixed optical lens system or have focus and optical zoom capability.

The audio component 1010 is configured to output and/or input audio signals. For example, the audio component 1010 includes a microphone ("MIC") configured to receive an external audio signal when the device 1000 is in an operation mode, such as a call mode, a recording mode, and a voice recognition mode. The received audio signal may be further stored in the memory 1004 or transmitted via the communication component 1016. In some embodiments, the audio component 1010 further includes a speaker to output audio signals.

The I/O interface 1012 provides an interface between the processing component 1002 and peripheral interface modules, such as a keyboard, a click wheel, buttons, and the like. The buttons may include, but are not limited to, a home button, a volume button, a starting button, and a locking button.

The sensor component 1014 includes one or more sensors to provide status assessments of various aspects of the device 1000. For instance, the sensor component 1014 may detect an open/closed status of the device 1000, relative positioning of components, e.g., the display and the keypad, of the device 1000, a change in position of the device 1000 or a component of the device 1000, a presence or absence of user contact with the device 1000, an orientation or an acceleration/deceleration of the device 1000, and a change in temperature of the device 1000. The sensor component 1014 may include a proximity sensor configured to detect the presence of nearby objects without any physical contact. The sensor component 1014 may also include a light sensor, such as a CMOS or CCD image sensor, for use in imaging applications. In some embodiments, the sensor component 1014 may also include an accelerometer sensor, a gyroscope sensor, a magnetic sensor, a pressure sensor, or a temperature sensor.

The communication component 1016 is configured to facilitate communication, wired or wirelessly, between the device 1000 and other devices. The device 1000 can access a wireless network based on a communication standard, such as WiFi, 2G, or 3G, or a combination thereof. In one exemplary embodiment, the communication component 1016 receives a broadcast signal or broadcast associated information from an external broadcast management system via a broadcast channel. In one exemplary embodiment, the communication component 1016 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 1000 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer-readable storage medium including instructions, such as included in the memory 1004, executable by the processor 1020 in the device 1000, for performing the above-described methods. For example, the non-transitory computer-readable storage medium may be a ROM, a RAM, a CD-ROM, a magnetic tape, a floppy disc, an optical data storage device, and the like.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A method for switching a display mode of a device, comprising:

receiving, by a processor of the device from a sensor, an intensity value of ambient light when the device is in a first control mode in which backlights of a liquid crystal display screen are adjusted in order to adjust a display brightness of the liquid crystal display screen;

determining, by the processor, whether the intensity value is less than a predetermined threshold for mode switching; and when the intensity value is less than the predetermined threshold, controlling, by the processor, the device to exit from the first control mode and enter a second control mode in which voltages provided to data lines of the liquid crystal display screen are scaled according to a ratio and independent of the backlights in order to adjust the display brightness of the liquid crystal display screen, wherein the voltages are drain voltages of liquid crystal display units of the liquid crystal display screen, and wherein different ratios for scaling the voltages correspond to different levels of the second control mode, and the different levels of the second control mode correspond to different ranges of the intensity value of ambient light.

2. The method of claim 1, further comprising:

determining whether the intensity value is less than a previously received intensity value when the device is in the first control mode; and when the intensity value is less than the previously received intensity value, adjusting the backlights to reduce backlight brightness of the liquid crystal display screen.

3. The method of claim 2, wherein adjusting the backlights to reduce the backlight brightness of the liquid crystal display screen comprises:

determining the backlight brightness corresponding to the intensity value according to a second correspondence relationship between intensity values and backlight brightness; and adjusting the backlights of the liquid crystal display screen to achieve the determined backlight brightness.

4. A method for switching a display mode of a device, comprising:

receiving, by a processor of the device from a sensor, an intensity value of ambient light when the device is in a first control mode in which voltages provided to data lines of a liquid crystal display screen are scaled according to a ratio and independent of backlights of the liquid crystal display screen in order to adjust a display brightness of the liquid crystal display screen, wherein the voltages are drain voltages of liquid crystal display units of the liquid crystal display screen and wherein different ratios for scaling the voltages correspond to different levels of the first control mode, and the different levels of the first control mode correspond to different ranges of the intensity value of ambient light;

determining, by the processor, whether the intensity value is greater than a predetermined threshold for mode switching; and when the intensity value is greater than the predetermined threshold, controlling, by the processor, the device to exit from the first control mode and enter a second control mode in which the backlights are adjusted in order to adjust the display brightness of the liquid crystal display screen.

5. The method of claim 4, wherein the exiting from the first control mode comprises:

providing the voltages without scaling to the data lines of the liquid crystal display screen.

6. The method of claim 4, wherein the entering the second control mode in which the backlights of the liquid crystal display screen are adjusted in order to adjust the display brightness of the liquid crystal display screen further comprising:

determining backlight brightness corresponding to the intensity value according to a second correspondence relationship between intensity values and backlight brightness; and adjusting the backlights of the liquid crystal display screen to achieve the determined backlight brightness.

7. A device for switching a display mode, comprising:

a processor; and a memory for storing instructions executable by the processor;

wherein the instructions, when executed by the processor, cause the processor to:

receive an intensity value of ambient light from a sensor when the device is in a first control mode in which backlights of a liquid crystal display screen are adjusted in order to adjust a display brightness of the liquid crystal display screen;

determine whether the intensity value is less than a predetermined threshold for mode switching; and when the intensity value is less than the predetermined threshold, control the device to exit from the first control mode and enter a second control mode in which voltages provided to data lines of the liquid crystal display screen are scaled according to a ratio and independent of the backlights in order to adjust the display brightness of the liquid crystal display screen, wherein the voltages are drain voltages of liquid crystal display units of the liquid crystal display screen, and wherein different ratios for scaling the voltages correspond to different levels of the second control mode, and the different levels of the second control mode correspond to different ranges of the intensity value of ambient light.

8. The device of claim 7, wherein the instructions, when executed by the processor, further cause the processor to:

determine whether the intensity value is less than a previously received intensity value when the device is in the first control mode; and when the intensity value is less than the previously received intensity value, adjust the backlights to reduce backlight brightness of the liquid crystal display screen.

9. The device of claim 8, wherein the instructions, when executed by the processor, further cause the processor to:

determine the backlight brightness corresponding to the intensity value according to a second correspondence relationship between intensity values and backlight brightness; and adjust the backlights of the liquid crystal display screen to achieve the determined backlight brightness.

10. A device for switching a display mode, comprising:

a processor; and a memory for storing instructions executable by the processor;

wherein the instructions, when executed by the processor, cause the processor to:

receive an intensity value of ambient light from a sensor when the device is in a first control mode in which voltages provided to data lines of a liquid crystal display screen are scaled according to a ratio and independent of backlights of the liquid crystal display screen in order to adjust a display brightness of the liquid crystal display screen, wherein the voltages are drain voltages of liquid crystal display units of the liquid crystal display screen, and wherein different ratios for scaling the voltages correspond to different levels of the first control mode, and the different levels of the first control mode correspond to different ranges of the intensity value of ambient light;

determine whether the intensity value is greater than a predetermined threshold for mode switching; and when the intensity value is greater than the predetermined threshold, control the device to exit from the first control mode and enter a second control mode in which the backlights are adjusted in order to adjust the display brightness of the liquid crystal display screen.

11. The device of claim 10, wherein the instructions, when executed by the processor, further cause the processor to:

provide the voltages without scaling to the data lines of the liquid crystal display screen.

12. The device of claim 10, wherein the instructions, when executed by the processor, further cause the processor to:

determine backlight brightness corresponding to the intensity value according to a second correspondence relationship between intensity values and backlight brightness; and adjust the backlights of the liquid crystal display screen to achieve the determined backlight brightness.

* * * * *